US006669543B2

(12) United States Patent
Price et al.

(10) Patent No.: US 6,669,543 B2
(45) Date of Patent: Dec. 30, 2003

(54) INTERCHANGEABLE HANDLE GRIP ASSEMBLY, CONVERSION KIT, AND TOOLS INCORPORATING SAME

(75) Inventors: Scott D. Price, Lebanon, NJ (US); Thomas G. Hart, North Brunswick, NJ (US); R. Michael McCalley, Jr., Bethlehem, PA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 188 days.

(21) Appl. No.: 10/012,588

(22) Filed: Oct. 31, 2001

(65) Prior Publication Data

US 2003/0083005 A1 May 1, 2003

(51) Int. Cl.[7] ..... B24B 23/00

(52) U.S. Cl. ..... 451/357; 451/358; 451/359; 451/456

(58) Field of Search ..... 451/354, 355, 451/356, 357, 358, 359, 442, 456; 16/110.1, 421, 422, 426, 430

(56) References Cited

U.S. PATENT DOCUMENTS

| | | | | |
|---|---|---|---|---|
| 3,854,897 A | * | 12/1974 | Attinger | 451/356 |
| 4,302,910 A | | 12/1981 | Tschacher | |
| 5,074,081 A | | 12/1991 | Beth et al. | |
| 5,172,522 A | | 12/1992 | Jares | |
| D351,976 S | | 11/1994 | Morey | |
| 5,558,570 A | | 9/1996 | Nakamura et al. | |
| 5,581,842 A | | 12/1996 | Seith | |
| 5,881,822 A | | 3/1999 | Sienkiewycz et al. | |
| 5,944,119 A | | 8/1999 | Hsieh | |
| 6,148,931 A | | 11/2000 | Nyber et al. | |
| 6,485,360 B1 | * | 11/2002 | Hutchins | 451/357 |
| 6,558,235 B2 | * | 5/2003 | Berg et al. | 451/41 |
| 2002/0111127 A1 | * | 8/2002 | Tseng | 451/358 |

FOREIGN PATENT DOCUMENTS

EP 0 387 410 9/1990

OTHER PUBLICATIONS

Ingersoll–Rand Automotive Power Tools Catalog, Form 52114–F, Copyright 1998 Ingersoll–Rand Company, Liberty Corner, NJ, pp. 29–36.

Copy of European Search Report dated Feb. 14, 2003 for European Patent Application No. 02257548.4.

* cited by examiner

*Primary Examiner*—Timothy V. Eley
(74) *Attorney, Agent, or Firm*—Michael Best & Friedrich LLP

(57) ABSTRACT

An interchangeable handle grip assembly, conversion kit, and tools having an interchangeable handle grip are provided having an inlet extension tube and an outlet extension tube. The assembly includes a housing extension having a mounting bracket into which the inlet extension tube and the outlet extension tube are inserted. An extension grip cover fitted to cover at least a portion of the mounting bracket provides a gripping surface thereon.

20 Claims, 5 Drawing Sheets

INTERCHANGEABLE HANDLE GRIP ASSEMBLY, CONVERSION KIT, AND TOOLS INCORPORATING SAME

BACKGROUND OF THE INVENTION

This invention relates generally to grips for powered tools and, more particularly, to an interchangeable handle grip assembly and a conversion kit for interchanging the palm grip of a pneumatic power tool to create an extended grip for enhanced control.

Currently, certain pneumatic operated tools having a grinding, buffing, polishing, or sanding wheel utilize a movable platen on which is secured a sheet of suitable material for the operation to be performed. The platen is below a main housing portion of the tool which contains a motor coupled to the platen for effecting movement thereof. A main handle portion is typically provided that, in the case of a pneumatic tool such as a palm sander, is configured for single-handed use by fitting the palm of a user. The smaller sizes of these palm-fitting tools are particularly advantageous for operations in confined or otherwise limited working spaces. Exemplary pneumatic tools in this regard are the Models IR 351, 354, 355 and 359 air-driven orbital sanders available from Ingersoll-Rand Company, Woodcliff Lake, N.J.

For operations requiring added gripping area, long-handled pneumatic tools are also available with an exemplary tool in this regard being the Model IR 352 long-handled grip air orbital sander also available from Ingersoll-Rand Company, Woodcliff Lake, N.J. The added gripping areas of these tools provide for added comfort by providing an alternate gripping surface that can be used alone using one hand or in combination with a main handle portion for two-handed operation, thereby providing added leverage and comfort, especially over extended operating periods.

Thus, in order to have the capability of optimally performing both single- and two-handed operations generally required a user to obtain both a palm-fitting tool and a tool with a long-handled grip, respectively.

The foregoing illustrates limitations known to exist in present devices and methods. Thus it is apparent that it would be advantageous to provide an alternative directed to overcoming one or more of the limitations set forth above. Accordingly, a suitable alternative is provided including features more fully disclosed hereinafter.

SUMMARY OF THE INVENTION

According to the present invention, an interchangeable handle grip assembly, conversion kit, and tools having an interchangeable handle grip are provided having an inlet extension tube and an outlet extension tube. The assembly includes a housing extension having a mounting bracket into which the inlet extension tube and the outlet extension tube are inserted. An extension grip cover fitted to cover at least a portion of the mounting bracket provides a gripping surface thereon.

The foregoing and other aspects of the invention will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENTS

Figure 1:
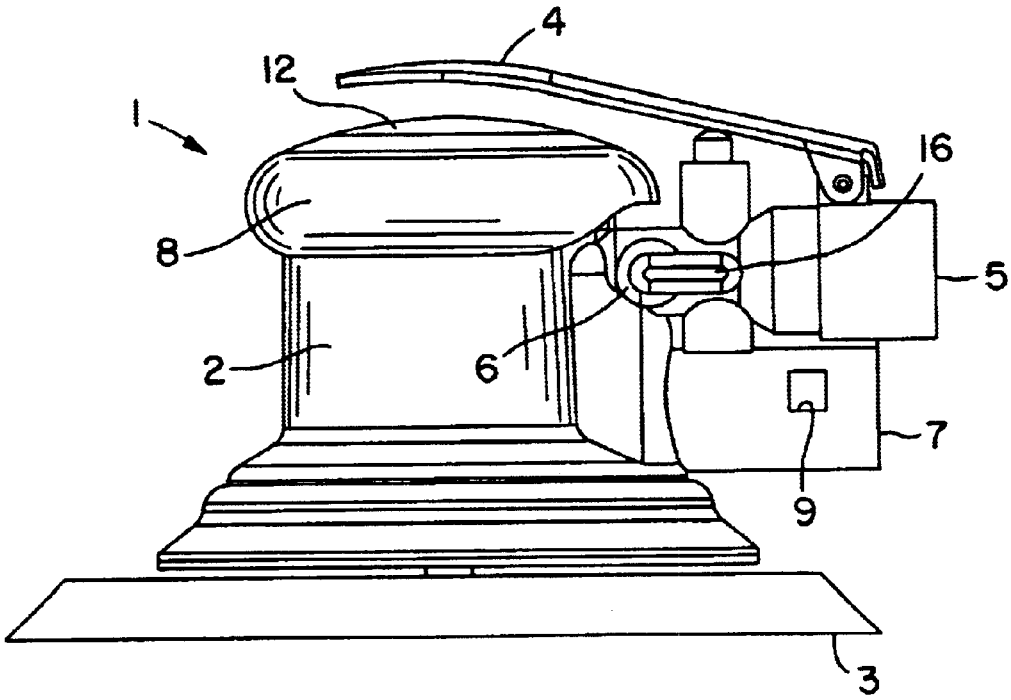
FIG. 1 PRIOR ART
FIG. 1 is a view of a conventional air orbital palm-sander.

The invention is best understood by reference to the accompanying drawings in which like reference numbers refer to like parts. It is emphasized that, according to common practice, the various dimensions of the component parts as shown in the drawings are not to scale and have been enlarged for clarity.

Figure 2:
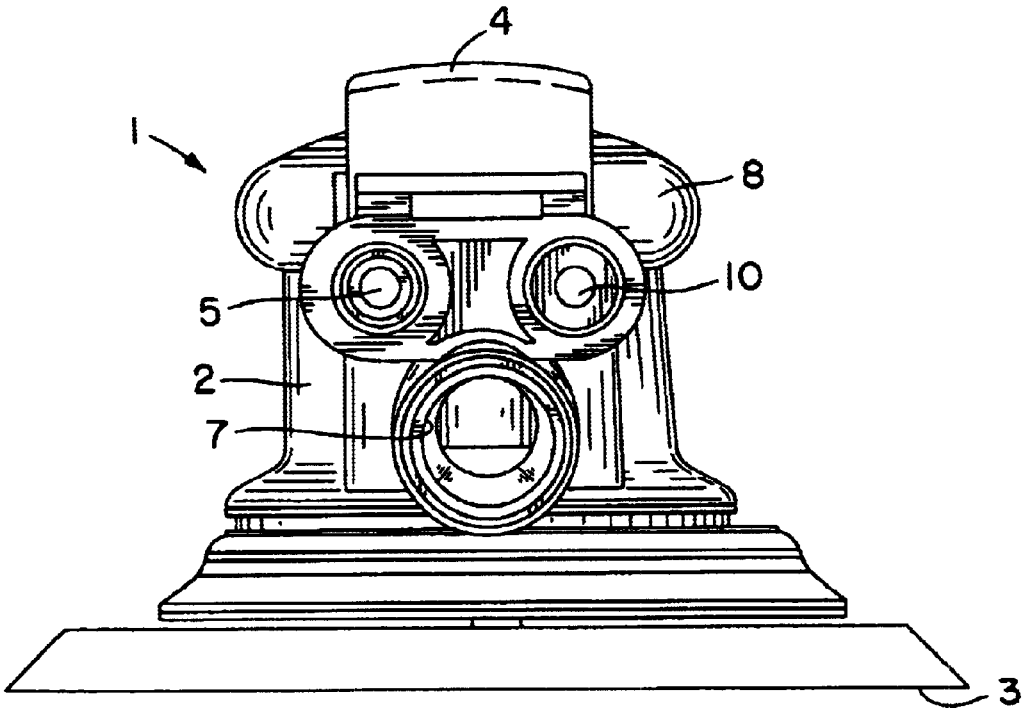
FIG. 2 PRIOR ART
FIG. 2 is a view of the conventional air orbital sander shown in FIG. 1.

Referring now to the drawings, shown in FIGS. 1 and 2, a pneumatic power tool in the form of a conventional air orbital sander is generally designated by the reference numeral 1. The sander comprises a motor housing portion 2, a sanding disk 3, and an operating lever 4, which when depressed, causes the motor to run on compressed pneumatic fluid and work to be accomplished by the sanding disk 3. Compressed pneumatic fluid is supplied at inlet 5 by a conventional pneumatic hose connection (not shown), the flow rate of which is controlled by an adjustable flow knob 6 having an actuator wing 16 to facilitate turning the knob.

Figure 4:
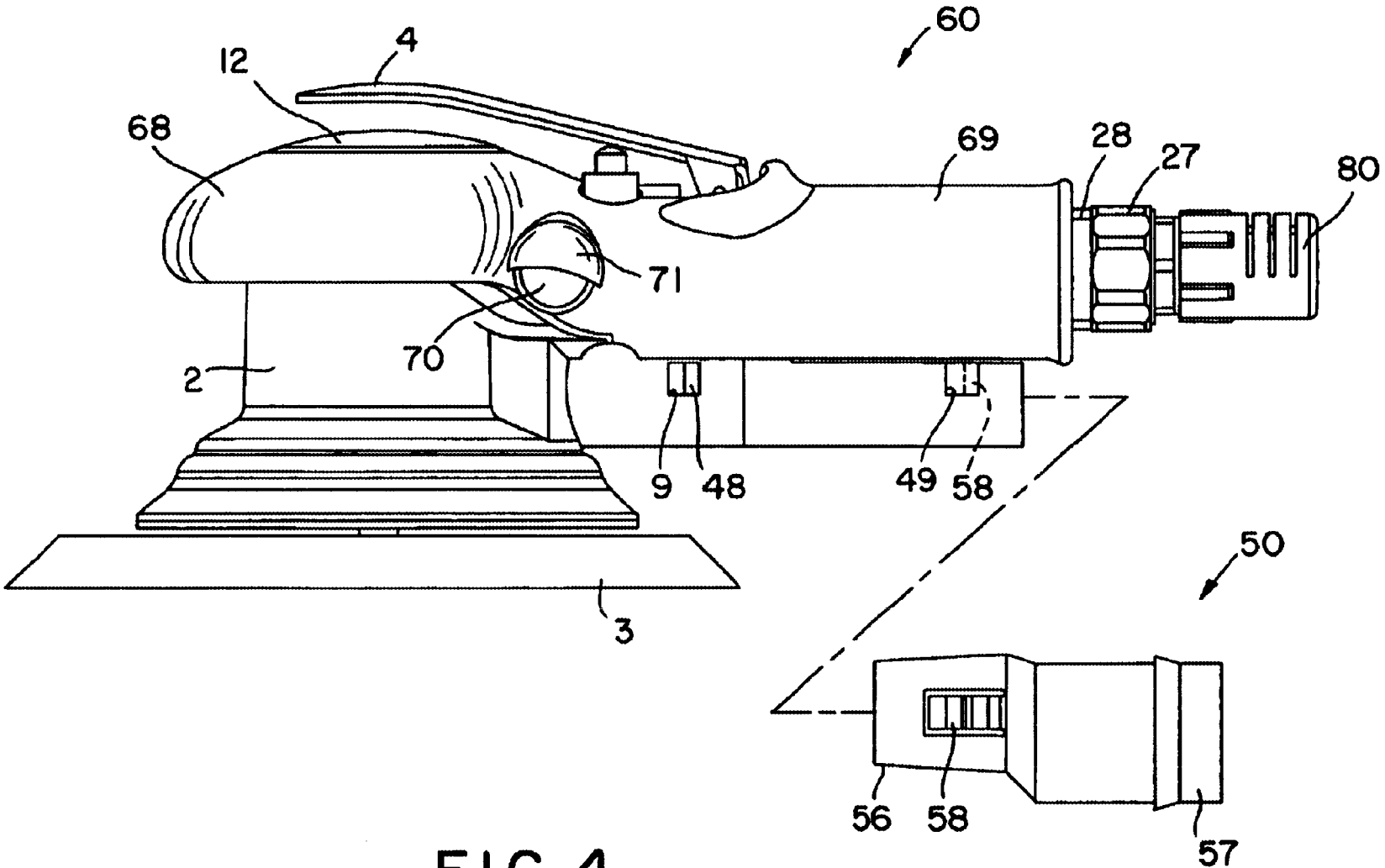
FIG. 4 is a side view of the pneumatic sander of FIG. 3 assembled with an interchangeable handle grip assembly according to the present invention with an unattached vacuum adaptor.

Preferably when used as a pneumatic sander, a vacuum port 7 is provided for connecting to a central or portable vacuum system via a tubular vacuum adapter 50 shown in FIG. 4, to maintain a clean, dust-free environment. Vacuum adapter 50 has a tapered forward portion 56 that fits into vacuum port 7 and attaches to pneumatic sander 1 via a resilient latch 58 that engages an aperture 9 on pneumatic sander 1 as shown in FIG. 1. A rear attachment port 57 is configured to attach to a vacuum hose or system (not shown). An exemplary model of pneumatic sander 1 is the Model IR4151 vacuum-ready random orbital sander available from Ingersoll-Rand Company, Woodcliff Lake, N.J. which is shown and described in commonly assigned U.S. Pat. Nos. 5,581,842 and Des. 351,976, the disclosures of which are incorporated by reference herein.

As shown in FIGS. 1 and 2, pneumatic sander 1 is provided with an interchangeable grip ring 8 having an inner annular hole that engages a cylindrical mounting post 12 located on motor housing portion 2 via an interference fit. Grip ring 8 is preferably made of an elastomeric material and is sized to match the size of a user's hand for single-handed operation.

Figure 3:
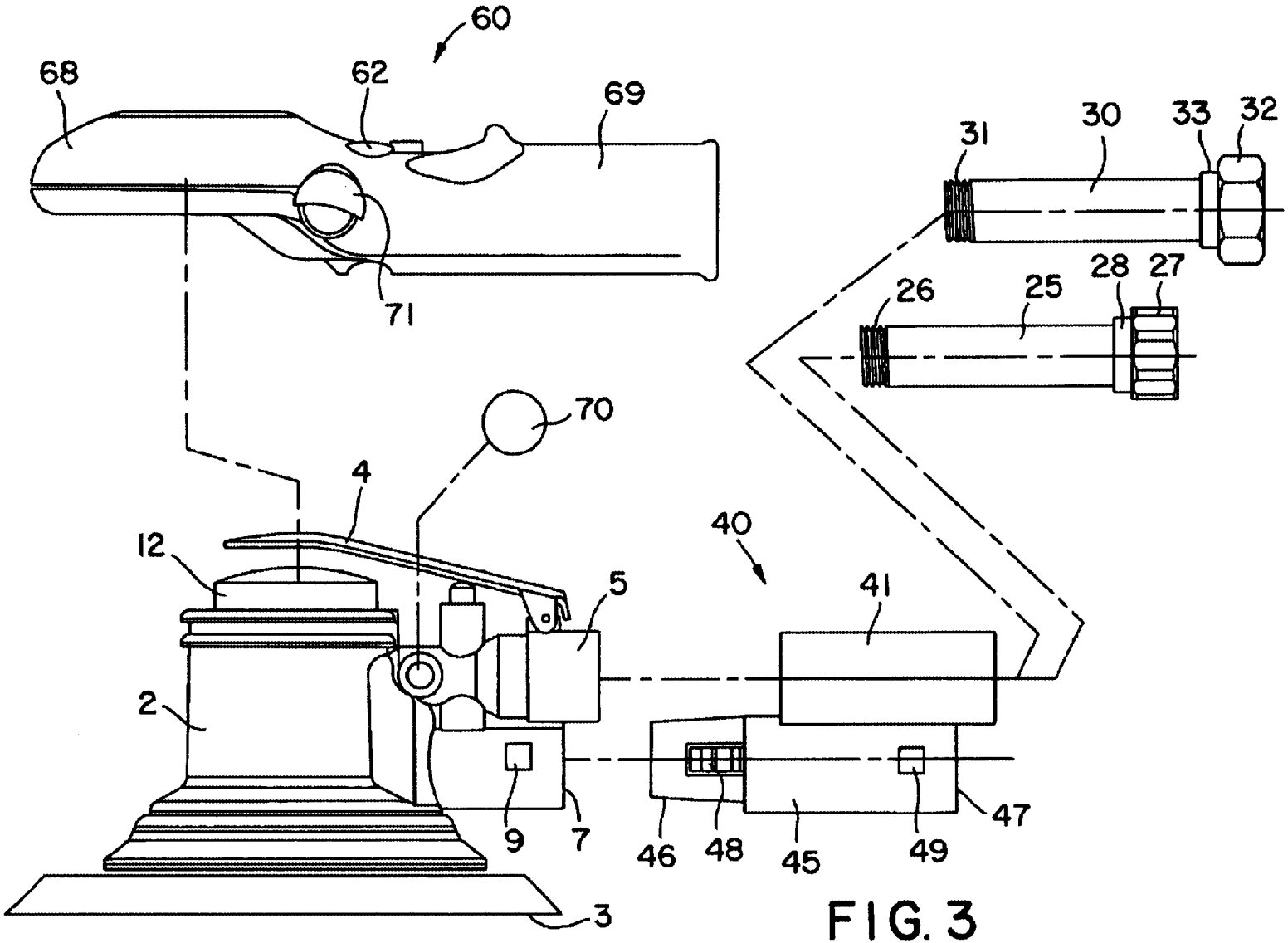
FIG. 3 is an exploded side view of an interchangeable handle grip assembly showing the component parts in pre-assembly relationship with a conventional pneumatic sander.

According to the present invention, an interchangeable handle grip assembly is provided having a housing extension 40, an inlet extension tube 25, an outlet extension tube 30, an extension grip cover 60, and an optional control knob 70 as shown in FIGS. 3–6. Turning to FIG. 3, shown is pneumatic sander 1 of FIG. 1 with grip ring 8 removed.

Figure 6:
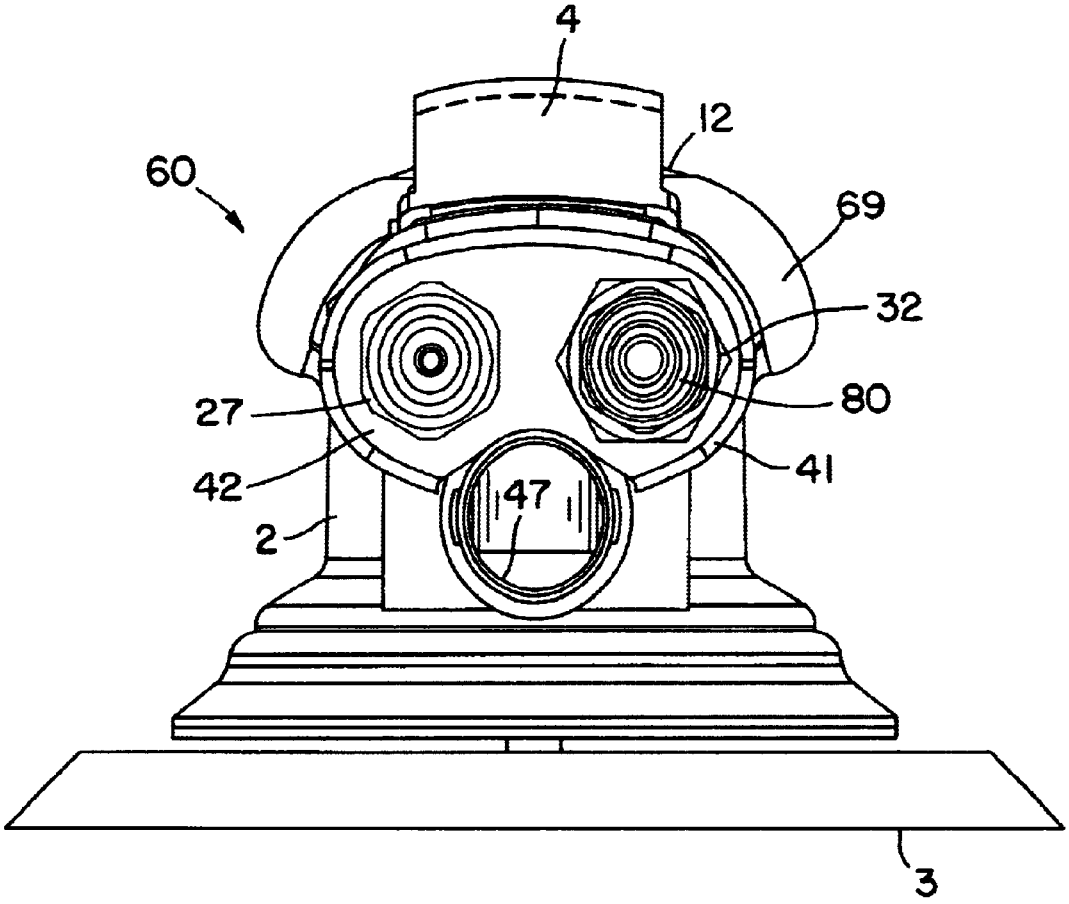
FIG. 6 is a rear view of the pneumatic sander of FIG. 5 assembled with an interchangeable handle grip assembly according to the present invention with an attached muffler.

A housing extension 40 is provided having a mounting bracket 41 which, preferably is a longitudinally concave shell having a substantially elliptical cross-section, and an end plate 42 as shown in FIG. 6. As described in detail below, when attached to pneumatic sander 1 via inlet extension tube 25 and outlet extension tube 30, mounting bracket shell 41 acts as a support for extension grip cover 60. Preferably provided on mounting bracket shell 41 is a vacuum port extension 45 having a tapered forward portion 46 that fits into vacuum port 7 and attaches to pneumatic sander 1 via a resilient latch 48 that engages aperture 9 on pneumatic sander 1 as shown in FIG. 4. Vacuum port extension 45 is provided with a vacuum port 47 that fits tapered forward portion 56 of vacuum adapter 50 for attachment to a central or portable vacuum system or a port plug (not shown) when not in use. An aperture 49 is also provided to engage resilient latch 58 of vacuum adapter 50 when tapered forward portion 56 is inserted fully into vacuum port 7.

Figure 5:
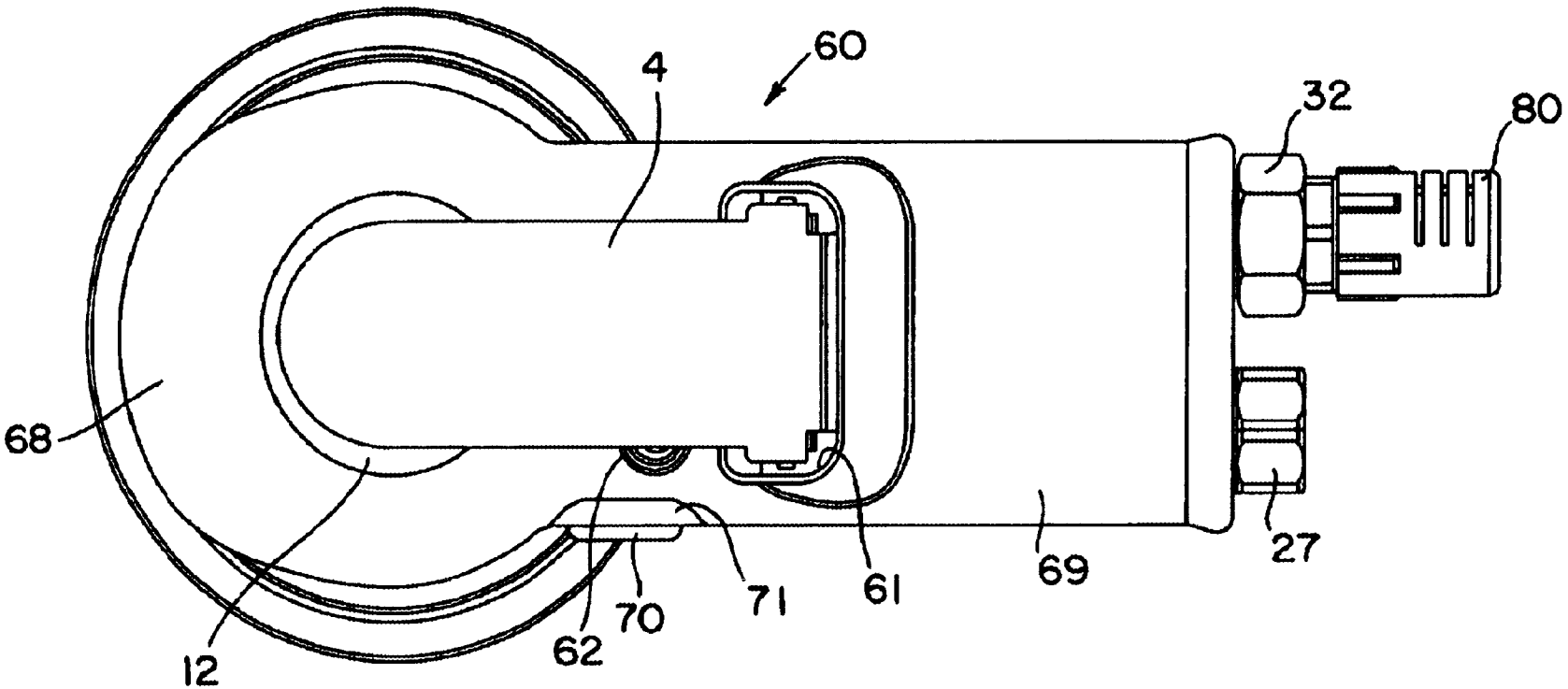
FIG. 5 is a top view of the pneumatic sander of FIG. 3 assembled with an interchangeable handle grip assembly according to the present invention with an attached muffler.

Also shown in FIG. 3 are an inlet extension tube 25 and an outlet extension tube 30. Inlet extension tube 25 has an externally threaded portion 26 on one end that mates with inner threads of inlet 5 and an inlet port connector 27 on the other end that is disposed next to a shoulder portion 28. Inlet port connector 27 is preferably internally threaded for attachment to a compressed air source (not shown). Outlet extension tube 30 has an externally threaded portion 31 on one end that mates with inner threads of exhaust outlet 10 and an exhaust port connector 32 on the other end that is disposed next to a shoulder portion 33. Exhaust port connector 32 is preferably internally threaded for attachment to a muffler 80 as shown in FIG. 5. In addition to securing the housing extension 40 to pneumatic sander 1, when attached to pneumatic sander 1, inlet extension tube 25 and outlet extension tube 30 are in fluid communication with and extend inlet 5 and exhaust outlet 10, respectively, to the end of the extension grip cover 60.

Extension grip cover 60 is preferably made of a flexible, elastomeric material and has an outer surface shaped to have an ergonomically contoured design. As shown in FIGS. 4 and 5, extension grip cover 60 includes a grip ring portion 68 configured to fit over and engage cylindrical mounting post 12 and an extended handle portion 69 having an undersurface configured to stretch fit over and engage housing extension 40. Preferably, a longitudinal lip along both sides of the undersurface of the grip cover are provided to achieve attachment to the housing extension 40. Through holes and apertures (such as a hole 62 to accommodate an actuator for operating lever 4 and an aperture 61 to accommodate operating lever 4) and contours (such as shroud 71 for a control knob 70) can be provided to accommodate features to be located under or through the extension grip cover 60. Although shown with an optional control knob 70 to be used in lieu of knob 6 for ease of operation, extension grip cover may alternatively be configured to accommodate knob 6 and its actuator wing 16.

Conversion between a pneumatic sander having a palm configuration with grip ring 8 (as shown in FIGS. 1 and 2) to a pneumatic sander having an elongated grip configuration with extension grip cover 60 (as shown in FIGS. 4–6) may be accomplished as follows. Turning to FIG. 3, after removing grip ring 8 from cylindrical mounting post 12 and knob 6 (if it is to be changed out for control knob 70), housing extension 40 is aligned with pneumatic sander 1 as shown by the dotted lines in FIG. 3. If present for use with a vacuum system, tapered portion 46 of vacuum port extension 45 is inserted into vacuum port 7 until resilient latch 48 engages aperture 9. The threaded portions 26, 31 of inlet extension tube 25 and outlet extension tube 30, respectively, are then inserted into holes located in end plate 42, threaded into inlet 5 and exhaust outlet 10, and tightened until shoulder portions 28, 33 compress against end plate 42 thereby capturing and securely fastening housing extension 40 to the body of pneumatic sander 1.

After sliding operating lever 4 through aperture 62 and aligning any through-holes with any underlying features to protrude through extension grip cover 60, grip ring portion 68 is then slid over cylindrical mounting post 12 and extended handle portion 69 is stretched around mounting bracket 41 to produce the pneumatic sander having an elongated grip configuration as shown in FIGS. 4, 5, and 6. Any remaining accessories, including vacuum adapter 50 and muffler 80, are then inserted into their corresponding ports as described above. Reversion from a pneumatic sander having an elongated grip configuration with extension grip cover 60 back to a pneumatic sander having a palm configuration with grip ring 8 is accomplished by simply reversing the steps described above.

Thus, according to the present invention, an interchangeable handle grip assembly as described above is provided that permits the interchangeability between a pneumatic tool for single-handed use and a pneumatic tool having an extended handle with additional hand grip area. Among the advantages realized is the easy conversion between these tools using a minimum number of parts while also utilizing a single underlying tool body. Thus, the interchangeable handle grip assembly may be included with pneumatic tools such as a pneumatic sander to provide a two-in-one tool. Moreover, in addition to being able to be provided as original equipment with such tools, the interchangeable handle grip assembly may also be provided as a stand alone accessory or as a retrofit conversion kit.

While embodiments and applications of this invention have been shown and described, it will be apparent to those skilled in the art that many more modifications are possible without departing from the inventive concepts herein described. For example, although shown and described above with a mounting bracket 41 having a vacuum port extension 45 and tapered forward portion 46 that fits into a vacuum port 7, it is envisioned that for pneumatic devices not having a vacuum port, housing extension 40 may be configured for attachment to a pneumatic tool using only mounting bracket 41 that is anchored via inlet extension tube 25 and outlet extension tube 30 as described in detail above. Additionally, although described above with respect to use with pneumatic orbital sanders, it is contemplated that the interchangeable handle grip assembly according to the present invention may be incorporated into other pneumatic devices in which the ability to change between shorter and longer grips is desired.

It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. An interchangeable handle grip assembly for use with a pneumatic tool, comprising:

an inlet extension tube and an outlet extension tube;

a housing extension having a mounting bracket into which said inlet extension tube and said outlet extension tube are inserted;

an extension grip cover fitted to cover at least a portion of said mounting bracket to provide a gripping surface thereon.

2. The interchangeable handle grip assembly according to claim 1, wherein said mounting bracket is a longitudinally concave shell having a substantially elliptical cross-section and an end plate.

3. The interchangeable handle grip assembly according to claim 1, wherein said mounting bracket shell further comprises a vacuum port extension attached thereto.

4. The interchangeable handle grip assembly according to claim 1, wherein said inlet extension tube and said outlet extension tube each have a first end having an externally threaded portion and a second end opposite said first end having a connector.

5. The interchangeable handle grip assembly according to claim 1, wherein said extension grip cover is made of an elastomeric material.

6. The interchangeable handle grip assembly according to claim 1, wherein said extension grip cover further comprises an extended handle portion having an undersurface configured to fit over and engage said housing extension.

7. The interchangeable handle grip assembly according to claim 6, wherein said extension grip cover further comprises a longitudinal lip along both sides of said undersurface for attachment to said housing extension.

8. The interchangeable handle grip assembly according to claim 1, wherein said pneumatic tool is an orbital sander.

9. A pneumatic tool having an interchangeable handle grip assembly, comprising: an inlet and an exhaust outlet;

an inlet extension tube configured to attach to said inlet and an outlet extension tube configured to attach to said exhaust outlet;

a housing extension having a mounting bracket into which said inlet extension tube and said outlet extension tube are inserted; and an extension grip cover fitted to cover at least a portion of said mounting bracket to provide a gripping surface thereon.

10. The pneumatic tool according to claim 9, wherein said mounting bracket is a longitudinally concave shell having a substantially elliptical cross-section and an end plate.

11. The pneumatic tool according to claim 9, wherein said pneumatic tool further comprises a vacuum port and said mounting bracket includes a vacuum port extension attached thereto and configured for attachment to said vacuum port.

12. The pneumatic tool according to claim 9, wherein said inlet extension tube has a first end having an externally threaded portion that mates with inner threads of said inlet; and said outlet extension tube has a first end having an externally threaded portion that mates with inner threads of said exhaust outlet.

13. The pneumatic tool according to claim 12, wherein said inlet extension tube has a second end opposite said first end having an inlet port connector disposed next to an inner shoulder portion; and said outlet extension tube has a second end opposite said first end having an exhaust port connector disposed next to an inner shoulder portion.

14. The pneumatic tool according to claim 9, wherein said extension grip cover is made of an elastomeric material.

15. The pneumatic tool according to claim 9, wherein said pneumatic tool further comprises a cylindrical mounting post and said extension grip cover includes a grip ring portion configured to fit over and engage said cylindrical mounting post.

16. The pneumatic tool according to claim 9, wherein said extension grip cover further comprises an extended handle portion having an undersurface configured to fit over and engage said housing extension.

17. The pneumatic tool according to claim 16, wherein said extension grip cover further comprises a longitudinal lip along both sides of said undersurface for attachment to said housing extension.

18. The pneumatic tool according to claim 9, wherein said pneumatic tool is an orbital sander.

19. A conversion kit for a pneumatic tool comprising:

an inlet extension tube and an outlet extension tube;

a housing extension having a mounting bracket with a longitudinally concave shell having a substantially elliptical cross-section and an end plate into which said inlet extension tube and said outlet extension tube are inserted; and an extension grip cover fitted to cover at least a portion of said mounting bracket to provide a gripping surface thereon.

20. The conversion kit according to claim 19, wherein said mounting bracket further comprises a vacuum port extension attached thereto.

* * * * *

UNITED STATES PATENT AND TRADEMARK OFFICE

CERTIFICATE OF CORRECTION

PATENT NO. : 6,669,543 B2 
DATED : December 30, 2003
INVENTOR(S) : Scott D. Price, Thomas G. Hart and R. Michael McCalley, Jr.

It is certified that error appears in the above-identified patent and that said Letters Patent is hereby corrected as shown below:

Column 1,
Lines 65-67, revise as follows:
-- FIG. 1 is a side view of a conventional air orbital palm-sander;
FIG. 2 is a rear view of the conventional air orbital sander shown in FIG. 1; --.

Column 5,
Line 6, after “bracket”, delete “shell”.

Signed and Sealed this

Second Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,669,543 B2 
DATED : December 30, 2003
INVENTOR(S) : Scott D. Price, Thomas G. Hart and R. Michael McCalley, Jr.

It is certified that error appears in the above-identified patent and that said Letters Patent is hereby corrected as shown below:

Column 1,
Lines 65-67, revise as follows:
-- FIG. 1 is a side view of a conventional air orbital palm-sander;
FIG. 2 is a rear view of the conventional air orbital sander shown in FIG. 1; --.

Column 5,
Line 6, after "bracket", delete "shell".

This certificate supersedes Certificate of Correction issued March 2, 2004.

Signed and Sealed this

Twenty-seventh Day of April, 2004

JON W. DUDAS
*Acting Director of the United States Patent and Trademark Office*